US007748923B2

(12) United States Patent
Bross et al.

(10) Patent No.: US 7,748,923 B2
(45) Date of Patent: Jul. 6, 2010

(54) GAP-FORMING ELEMENT FOR MOUNTING ON A SHAFT

(75) Inventors: Stephan Bross, Erpolzheim (DE); Ruediger Koepp, Ludwigshafen (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 11/106,484

(22) Filed: Apr. 15, 2005

(65) Prior Publication Data

US 2005/0244091 A1 Nov. 3, 2005

Related U.S. Application Data

(63) Continuation of application No. PCT/EP03/09503, filed on Aug. 28, 2003.

(30) Foreign Application Priority Data

Oct. 16, 2002 (DE) ..... 102 48 162

(51) Int. Cl.
*F16D 1/06* (2006.01)
*F16F 1/38* (2006.01)

(52) U.S. Cl. ..... 403/1; 403/225; 403/228

(58) Field of Classification Search ..... 403/1, 403/225–228; 277/637, 641, 607, 643, 579, 277/611, 639, 910; 384/220, 222, 245
See application file for complete search history.

(56) References Cited

U.S. PATENT DOCUMENTS 1,758,712 A * 5/1930 Morris ..... 267/270
1,991,077 A * 2/1935 Brittain, Jr. ..... 277/419
2,528,436 A * 10/1950 Johnson ..... 277/516
2,984,726 A * 5/1961 Roeser
3,331,609 A * 7/1967 Moran
3,418,001 A * 12/1968 Rentschler et al. ..... 277/589
3,574,347 A * 4/1971 Hughes
3,866,924 A * 2/1975 French ..... 277/505
4,007,924 A * 2/1977 Jorn et al. ..... 403/228
4,484,753 A * 11/1984 Kalsi ..... 277/336
4,543,011 A * 9/1985 Lindenthal ..... 403/338
4,700,953 A * 10/1987 Kuusela et al.

(Continued)

FOREIGN PATENT DOCUMENTS

DE 440816 A * 2/1927

(Continued)

*Primary Examiner*—Victor MacArthur
(74) *Attorney, Agent, or Firm*—Crowell & Moring, LLP

(57) ABSTRACT

An element is to be mounted on a shaft of a non-positive displacement machine and forms a gap for limited passage of a flowing medium. A bush-like part for mounting on a shaft of the machine has an outer periphery provided with a recess for accommodating a ring. During operation of the machine, the ring, which is partially surrounded on its faces by circular ring-shaped walls of the recess, forms an axial gap with the circular, ring-shaped walls of the recess and a radial gap with the bottom of the recess. The ring is held by frictional contact with a rigid wall which surrounds it. To reduce wear on rings made of soft, flowable material, a second recess is formed in the rigid wall and surrounds the faces of the ring that project from the walls of the bush-like part. One of the lateral bounds of the second recess is formed by a tubular part detachably joined to the rigid wall.

4 Claims, 1 Drawing Sheet

U.S. PATENT DOCUMENTS 5,531,564 A * 7/1996 Anttonen et al. ..... 415/104
5,788,137 A * 8/1998 Ku ..... 384/275
5,850,670 A * 12/1998 Boskovic
5,961,122 A * 10/1999 Marsi ..... 277/910
6,494,458 B2 * 12/2002 Uth
6,557,857 B1 * 5/2003 Goodman ..... 277/549
7,150,477 B2 * 12/2006 Reifschneider et al. ..... 277/579
2002/0125649 A1 * 9/2002 Bross et al. ..... 277/579

FOREIGN PATENT DOCUMENTS

DE 100 38 586 A1 2/2002
DE 100 62 204 A1 7/2002
EP 529379 A1 * 3/1993
GB 278305 * 2/1928
WO WO 02/12728 A1 2/2002

* cited by examiner

GAP-FORMING ELEMENT FOR MOUNTING ON A SHAFT

CROSS REFERENCE TO RELATED APPLICATIONS

This application is a continuation of international patent application no. PCT/EP2003/009503, filed Aug. 28, 2003, designating the United States of America, and published in German on Apr. 29, 2004 as WO 2004/036053, the entire disclosure of which is incorporated herein by reference. Priority is claimed based on Federal Republic of Germany patent application no. DE 102 48 162.8, filed Oct. 16, 2002.

BACKGROUND OF THE INVENTION

The present invention relates to an element which is to be mounted on the shaft of a non-positive displacement machine and which forms a gap for limited passage of a flowing medium, having a bush-like part which is to be mounted on the shaft of the non-positive displacement machine and whose outer periphery has a recess for a ring, the ring which is partially surrounded at its end faces by circularly annular walls of the recess during operation of the non-positive displacement machine a) forming an axial gap in each case with the circularly annular walls of the recess and forming a radial gap with the bottom of the recess, b) being held via frictional contact by a rigid wall surrounding the ring.

Somewhat similar elements are disclosed in international patent application no. WO 02/12728 (=DE 100 38 586) and published US patent application no. US 2002/125649 (=DE 100 62 204). In these documents, the element has served as a relief piston in an axial thrust balancing device or as a sealing bush in a shaft seal. A common feature of both applications was that a slotted resilient ring was used which was widened slightly during operation of the non-positive displacement machine by the prevailing pressure, pressed against the housing inner wall and fixed in such a way.

The present invention, however, is not aimed only at elements with slotted rings, but is intended also to be suitable for application in closed rings. Independently of their design, rings made from a soft, flowable material result in the problem that their edge zones on the one side are pressed gradually into the gap between the bush attached to the shaft and the surrounding housing hole by the pressure which acts on them. This results in increasing wear of the ring and the risk of the sealing action diminishing.

SUMMARY OF THE INVENTION

It is an object of the invention to provide an improved element which is to be mounted on a shaft of a non-positive displacement machine and which forms a gap (i.e., a passageway) for limited passage of a flowing medium.

Another object of the invention is to provide a shaft-mounted, gap-forming element which minimizes wear.

A further object of the invention is to provide a shaft-mounted, gap-forming element which exhibits increased ring service life and thus also increases the service life of the gap-forming element.

These and other objects are achieved in accordance with the present invention by providing an element for mounting on a shaft of a non-positive displacement machine, said element forming a gap for limited passage of a flowing medium and comprising a bush part for mounting on the shaft of the machine, said bush part having an outer periphery provided with a first recess for accommodating a ring, said ring having end faces which are partially surrounded by circularly annular walls of said first recess, and said ring a) forming an axial gap with the respective circularly annular walls of the recess and a radial gap with the bottom of the recess, and b) being held by frictional contact with a rigid wall surrounding the ring, wherein a second recess is formed in said rigid wall, said second recess enclosing the end faces of the ring which extend beyond the walls of said first recess in said bush part, and wherein said second recess is bounded laterally by a tubular part detachably joined to the rigid wall.

Thus, in accordance with the present invention, a recess is formed in the rigid wall surrounding the ring and surrounds the end faces of the ring that are free from the walls of the bush-like part, one of the lateral delimitations of the recess being formed by a tubular part detachably joined to the rigid wall.

As a result of the construction of the gap-forming element according to the invention, the ring is surrounded on all sides, and consequently no gap remains into which the ring could yield.

In order for it to be possible to move a closed ring into its position within the shaft-side bush, a delimitation ring which is detachably joined to the bush is arranged in that wall of the recess of said part which lies opposite the tubular part. It goes without saying that it is also possible in this way to mount a resilient ring which is separated by a longitudinally running gap. However, with less expenditure for the shaft-side bush-like part, this can also be widened and pushed over one of the lateral walls of the bush-like part.

A particular advantage of the invention is that the entire element, including the surrounding wall which in this case is likewise formed by a bush, can be assembled outside the non-positive displacement machine from separately manufactured parts to form a cartridge which is ready for installation.

The gap-forming element of the invention can be used advantageously as an axial thrust balancing device or as a shaft seal.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
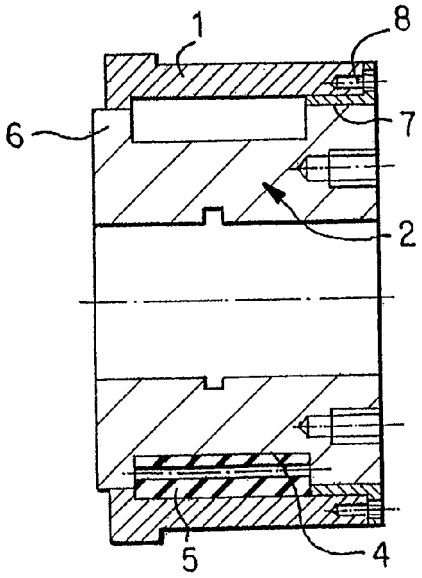
FIG. 1 is a sectional view of a gap-forming element which has a resilient ring that is divided in the axial direction by a slot and which is configured as an installable cartridge.
Figure 2A:
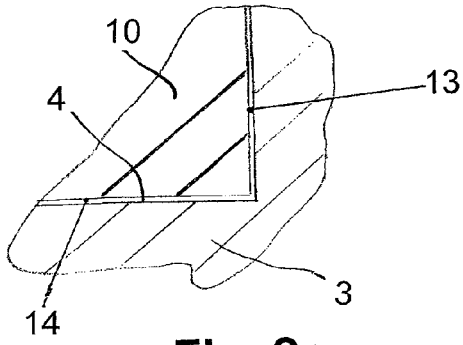
FIG. 2*a* is an enlarged detail view of a portion of FIG. 2.
Figure 2:
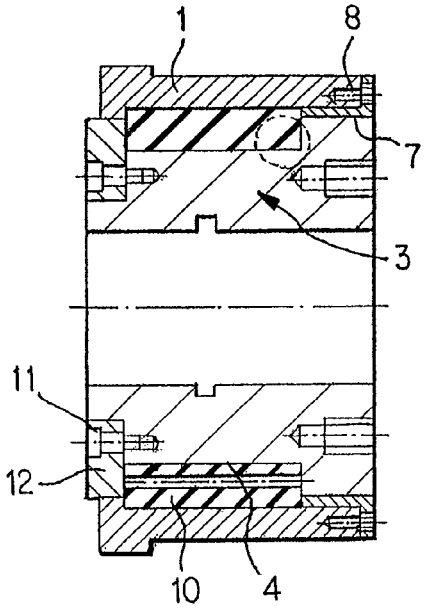
FIG. 2 is a sectional view of a cartridge which corresponds largely to FIG. 1, except that the gap-forming element has a closed ring.

The pre-assembled units or cartridges which are shown in FIGS. 1 and 2 serve as relief elements in axial thrust balancing devices. A common feature of both embodiments is a bush 1 which defines a rigid wall and is to be mounted in a rotationally fixed and nondisplaceable manner in a centrifugal pump housing (not shown). The remaining parts of the elements are each inserted into the bush 1. A further bush-like part, namely a bush 2 or 3, is arranged on the shaft (not shown) of the centrifugal pump.

In the embodiment according to FIG. 1, the bush part 2 has a first recess 4 into which a ring 5 is inserted. The ring 5 is comprised of a resilient material and is divided by an axially extending slot. The resilience and the slot make it possible for the ring 5 to be expanded and pushed over the side wall 6 of the bush and to be secured in the recess 4. The ring 5 is also received in a second recess in the bush 1 that is partly defined by the rigid wall of the bush as shown. As can be seen in FIG. 1, the rigid wall of bush 1 defining part of the second recess forms a circularly annular wall axially aligned with a circularly annular wall of the first recess. On the side of the cartridge which lies opposite the side wall 6 there is a tubular holding ring 7 which is inserted into the bush 1 after introduction of the bush 2 and the ring 5 and is fastened to the bush 1 by screws 8. Holding ring 7 has two effects: First, the holding ring 7 holds the cartridge together. Second, the holding ring 7 prevents the ring 5 from expanding into the region between the bush 1 and the bush part 2, as a result of which gradual wear is avoided in the region of an existing gap in the previously known configuration.

In the embodiment shown in FIG. 2, the bush part 3 has a recess 9 similar to recess 4 into which a closed ring 10 is pushed. In order to form a complete recess in which the ring is held, a bounding ring 12 which is fastened to the bush 3 by screws 11 is attached on the open side of the bush 3, that is to say, the side opposite from the holding ring 7. The holding ring 7 and the screws 8 correspond to those in the embodiment of FIG. 1.

FIG. 2*a* shows the axial gap 13 formed by the ring 10 and the circularly annular wall of recess 4 in bush 3 and the radial gap 14 formed by the ring 10 and the bottom of recess 4 in bush 3.

A modification results if, instead of a cartridge which is ready for installation, a bush is used which is fastened in the housing of the non-positive displacement machine and is connected to the other parts of the element only in the housing. The invention is nevertheless also used in a embodiment of this type which appears less advantageous.

Although it serves a different purpose, the construction of an element for sealing a shaft is in principle the same as in the thrust balancing relief devices described above. However, the corresponding parts are denoted there by other designations than in the exemplary embodiments presented here.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A gap-forming assembly for a non-positive displacement machine, said assembly comprising:

an inner bush for mounting on a shaft of the non-positive displacement machine;

said inner bush having an outer periphery provided with a first annular recess, said first annular recess having circularly annular walls and a bottom surface;

a resilient ring received in said first recess such that the end faces of the ring are partially surrounded by the circularly annular walls of said first recess and a remaining part of the end faces of said ring extend beyond the circularly annular walls of said first recess;

an outer bush surrounding said inner bush, said outer bush being adapted to be received in a rotationally fixed and non-displaceable manner in a housing of the non-positive displacement machine, and said inner bush being rotatable relative to said outer bush;

said outer bush having an inner periphery provided with a second annular recess having at least one circularly annular wall axially aligned with a corresponding circularly annular wall of the first recess; said second annular recess enclosing the remaining part of the end faces of the ring which extend beyond the circularly annular walls of said first recess such that the ring is surrounded on all sides;

wherein:

one end of said second annular recess is defined by a tubular holding part which is inserted into and detachably connected to said outer bush;

said ring is held in place by frictional contact with said outer bush, and said ring is constructed such that in the non-positive displacement machine, said ring during operation of said non-positive displacement machine forms an axial gap with each of the respective circularly annular walls of the first recess and forms a radial gap with the bottom surface of said first recess such that a gap passageway for limited passage of a flowing medium is formed by said axial gaps and said radial gap.

2. An assembly according to claim 1, wherein one end of said first annular recess is defined by a bounding ring that is detachably connected to the inner bush.

3. An assembly according to claim 2, wherein said bounding ring is disposed opposite said tubular holding part.

4. An assembly according to claim 1, wherein the resilient ring is a resilient ring pushed over a lateral wall of the inner bush.

* * * * *